US005318683A

United States Patent [19]

Smith et al.

[11] Patent Number: 5,318,683

[45] Date of Patent: Jun. 7, 1994

[54] ELECTRODEPOSITION SYSTEM

[75] Inventors: Robert Smith, Nashotah; Ron E. Toby, Oshkosh; John H. Germanson, Eden, all of Wis.

[73] Assignee: Quad/Tech, Inc., Pewaukee, Wis.

[21] Appl. No.: 12,241

[22] Filed: Feb. 1, 1993

[51] Int. Cl.[5] ..... C25D 17/00

[52] U.S. Cl. ..... 204/252; 204/259; 204/264

[58] Field of Search ..... 204/252, 259, 264, 284, 204/287, 263, 212

[56] References Cited

U.S. PATENT DOCUMENTS

| | | | |
|---|---|---|---|
| 2,667,270 | 1/1954 | Cady et al. | 204/238 X |
| 2,771,415 | 11/1956 | Ross | 204/238 |
| 3,450,625 | 6/1969 | Ramsey et al. | 204/287 X |
| 3,860,508 | 1/1975 | Durin | 204/263 X |
| 3,923,610 | 12/1975 | Bergin et al. | 204/32 R |
| 4,342,635 | 8/1982 | Becker et al. | 204/263 |
| 4,405,709 | 9/1983 | Katano et al. | 430/307 |
| 4,437,942 | 3/1984 | Datwyler | 204/6 |
| 5,009,755 | 4/1991 | Shor | 204/252 X |

*Primary Examiner*—Donald R. Valentine

*Attorney, Agent, or Firm*—Michael, Best & Friedrich

[57] ABSTRACT

The present invention provides an electrodeposition apparatus and a method for reconditioning gravure cylinders through electrodeposition. The electrodeposition apparatus includes a container for holding an ionic fluid bath and a reservoir for holding a supply of deposition material in fluid communication with the ionic fluid bath. An object, such as a gravure cylinder, is held in contact with the ionic fluid bath. Charges of opposite polarity are applied to the object and to the supply of deposition material. A barrier member and a diffusion member disposed between the supply of electrodeposition material and the object prevent contaminants from moving into contact with the object and also facilitate the dispersion of ions moving through the fluid bath between the supply of electrodeposition material and the object. Thus, once the charges are appropriately applied to the object and the supply of deposition material, ions will be attracted to the object in uniform manner to provide a uniform layer of deposition material on the object. Additionally, restrictive filters are used to filter fluid which is added to the ionic fluid bath and to facilitate uniform dispersion of this fluid along the entire length of the fluid bath.

24 Claims, 4 Drawing Sheets (TOTAL TIME: 3 HRS. 50 MINS.)

NEW METHOD (TOTAL TIME: 2 HRS. 30 MINS.)

ELECTRODEPOSITION SYSTEM

TECHNICAL FIELD

This invention relates to an electrodeposition system and method, particularly to an electroplating system for plating gravure cylinders.

BACKGROUND OF THE INVENTION

Electrodeposition has long been used as a method for plating objects with a particular material. Electrodeposition is a relatively easy way to coat an object with a material, such as copper, where it would be difficult to provide a thin uniform coating by other methods.

Electrodeposition has been used to plate gravure cylinders, which are commonly used in printing processes. A gravure cylinder is plated with a thin layer of a material such as copper and then the desired print is etched into the copper layer. In such cases, a steel or aluminum cylinder usually forms the substrate which supports the electrodeposition layer. Once the print run is finished, the gravure cylinder must be reconditioned so that a different print may be etched into the cylinder. Reconditioning requires that the electrodeposition layer be removed, at least partially, to remove the previous etching so that a new electrodeposition layer may be placed on the cylinder. As before, once the new layer of electrodeposition material covers the cylinder, the desired etching may be made for future printing.

An electrodeposition system requires an ionic fluid bath which contacts the object to be plated. The ionic fluid bath includes ions of the deposition material. A supply of the electrodeposition material must also be in contact with the ionic fluid bath to supply the fluid bath with additional ions once the plating process begins.

For example, when a gravure cylinder is to be plated with copper, the cylinder will be submerged or rotated while in contact with a fluid bath containing copper ions. A tray of copper nuggets or copper bars would typically be submerged in the fluid bath in proximity to the gravure cylinder. An electrical field would then be established across the object and the supply of deposition material. The charge applied to the object would be opposite to the charge of the ions in the fluid bath thus attracting the ions to the object. In this manner, the ions are deposited on the object forming a layer or plating on the object. Meanwhile, additional ions break free from the deposition material supply and enter the fluid bath generally replacing the ions that were attracted to the object. In the gravure cylinder . example, the cylinder can be rotated through the fluid bath while the electrodeposition process takes place so that a layer of deposition material will be applied generally over the entire surface of the gravure cylinder.

Often, during the electrodeposition process, oxides and other contaminants are given off when the electrodeposition material supply ionizes; that is, when ions break face from the deposition material supply and enters the fluid bath. This is due largely to impurities which exist in the supply material. Thus, the ionic fluid which is used in the fluid bath is usually cycled through a larger reservoir of ionic fluid. Before returning to the fluid bath, the ionic fluid is filtered and resupplied to the fluid bath. In Bergin et al., U.S. Pat. No. 3,923,610, a method is disclosed for copper plating a gravure cylinder in which a typical plating system is used. A cylinder is rotatably mounted in contact with an electrolyte which is retained in a vat. The electrolyte consists essentially of a solution of copper sulfate and sulfuric acid in water. The cylinder is partially immersed in the ionic fluid bath and rotated while an electric field is established across the cylinder and a solid copper supply.

A problem with prior art devices such as the Bergin device is that those devices were not able to deposit material on the object being plated in a precise uniform manner. This presented problems when plating or reconditioning objects such as gravure printing cylinders, which require an extremely precise and 15 uniformly smooth surface. To obtain such a desired uniform surface using prior art plating devices, an old layer of deposition material was first removed and then the object was thoroughly cleaned. Following its cleaning, the object was typically plated with a relatively thick layer of the electrodeposition material and then the layer underwent a refining process which involved rough cutting the electrodeposition layer to a generally uniform finish, fine cutting the rough cut finish, and then polishing the surface until it had the desired smooth and uniform characteristics. This process, however, was time consuming and wasted substantial electrodeposition material.

The inventor has determined that the nonuniformity of the electrodeposition layer achieved using prior art plating apparatus is caused largely by uneven dispersion of the ions as they are attracted to the object and by contaminants which enter the fluid bath and become attached to the object which is being plated. It would be advantageous to prevent contaminants from being introduced to the fluid bath from either the electrodeposition material supply or from the recycled ionic fluid which is introduced into the fluid bath. Additionally, it would be advantageous to uniformly disperse of ions in the fluid bath as ions are introduced into the fluid bath from either the electrodeposition material supply or from the ionic fluid being recycled to the fluid bath. For example, a problem with the prior art systems was that ionic fluid was introduced into the fluid bath through orifices which generally sprayed columns of fluid into the fluid bath. Such columnar spraying was found to cause uneven plating of the cylinder leaving high spots and low spots in the material deposited on the cylinder according to the location of the supply orifices.

Other methods and devices for electrodeposition of a material are disclosed in patents such as Datwyler, U.S. Pat. No. 4,437,942 and Katano et al., U.S. Pat. No. 4,405,709. However, nothing in these prior art references adequately addresses the problems discussed above.

SUMMARY OF THE INVENTION

The present invention provides an apparatus and a method for altering the surface of an object by affecting the amount of a deposition material disposed on the object. The object is maintained in fluid communication with an ionic fluid bath which includes ions of the deposition material. The apparatus includes a container for holding the ionic fluid bath and a reservoir for holding the deposition material in fluid communication with the ionic fluid bath. An electrical power source is operatively connected with the deposition material in the reservoir and the object and establishes an electrical field across the deposition material and the object. The electrical power source establishes a first charge at the object and a second charge at the deposition material in the reservoir. The first and second charges have opposite polarities and are of substantially equal magnitudes. The first and second charges cooperate to establish the electrical field intermediate the object and the deposition material via the ionic fluid bath. In this manner, the ionic fluid bath and the deposition material cooperate in response to the electrical field to effect deposition of the ions on the object.

A barrier is preferably placed intermediate the object and the reservoir means to impede the passage of contaminants from the deposition material to the object.

Additionally, a diffusion member is disposed intermediate the object and the reservoir to assist in diffusing the ions as the ions move through the ionic fluid bath during the deposition of the ions on the object.

A filter is also preferably provided for filtering fluid which is recycled or otherwise added to the ionic fluid bath. The filter is configured to provide uniform distribution of the filtering fluid into the ionic fluid bath.

The invention also contemplates a method for conditioning an object to provide a smooth, uniform finish on the object which is suitable for etching and use in gravure printing. The method of the invention requires fewer or shorter machining steps and finishing steps to obtain a uniform finish.

BRIEF DESCRIPTION OF THE DRAWINGS

The invention will hereafter be described with reference to the accompanying drawings, wherein like numerals denote like elements, and.

DETAILED DESCRIPTION OF A PREFERRED EMBODIMENT

Figure 1:
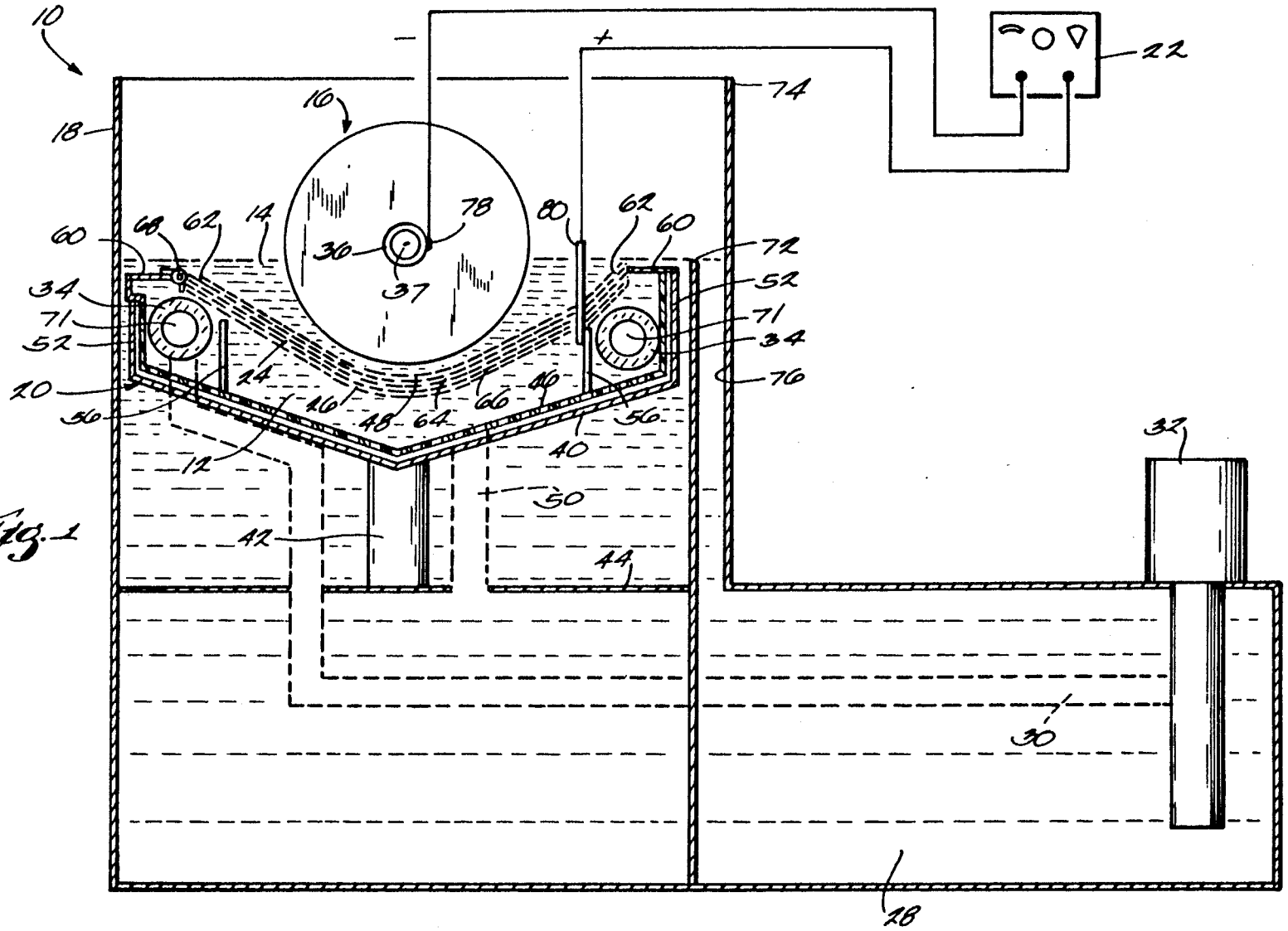
FIG. 1 is a schematic sectional view.

Referring now to the schematic sectional view of FIG. 1, an electrodeposition apparatus designated generally as 10 is shown to include a deposition material supply 12, an ionic fluid bath 14 which includes ions of the deposition material, an object 16 to which deposition material may be added or from which deposition material may be removed, a container 18 for holding ionic fluid bath 14, and a reservoir 20 for holding deposition material supply 12 in fluid communication with ionic fluid bath 14. An electrical power source 22 is operatively connected to deposition material supply 12 and object 16. A barrier 24 is disposed between object 16 and deposition material supply 12. Similarly, a diffusion member is also disposed between object 16 and deposition material supply 12.

A fluid supply 28 is in fluid communication with fluid bath 14 preferably via a conduit 30. A fluid pump 32 can be used to pump fluid through conduit 30 and into ionic fluid bath 14. In a preferred embodiment, the fluid is pumped through a filter 34 before being dispersed throughout ionic fluid bath 14. Filter 34 is preferably a filter tube extending substantially the full length of reservoir 20.

Deposition material supply 12 may consist of any of a number of materials used in electrodeposition processes. The material must be able to undergo ionization in order to replace the ions removed from ionic fluid bath 14 and plated on object 16. A good example of a deposition material which can readily be used is copper, and copper will be used as the primary example throughout this description without implying any limitations to the type of deposition material which might be used. In the case of copper, copper ions have a positive charge, so power source 22 must supply a negative charge to object 16 and a positive charge to deposition material supply 12 to effect plating. In effect, the negatively charged object attracts the positively charged copper ions which are then deposited on the surface of object 16. As the copper ions are deposited on object 16 and removed from ionic fluid bath 14, additional copper ions are induced by the electrical potential present between object 16 and deposition material supply 12 to separate from deposition material supply 12 and to replace the ions which have been so separated from the ionic fluid bath 14.

Ionic fluid bath 14 is comprised of a carrier fluid and ions generally dispersed throughout the fluid. Continuing with the copper example, a copper sulfate would typically be mixed with a fluid such as water. Other additives, which are commonly used in the art, can also be added. The copper sulfate breaks into ions of copper and sulfate, the copper ions having a positive charge and the sulfate ions having a negative charge. Thus, when an electric field is established intermediate object 16 and deposition material supply 12, the copper ions are attracted towards the negatively charged object 16 while the sulfate ions move towards reservoir 20. The copper ions will be deposited on the surface of object 16, while the sulfate ions move into proximity with the deposition material supply 12 and combine with naturally occurring oxides in the copper, forming a sludge which drops into reservoir 20. Of course, if a different deposition material is used which forms negative ions in ionic fluid bath 14, then power source 22 would be connected so that a positive charge would be supplied to object 16.

Object 16 can be an object of virtually any shape as long as it can receive an electric charge. Only that portion of object 16 which is in fluid communication with ionic fluid bath 14 will be plated with the deposition material. In the preferred embodiment, object 16 is a gravure roll which is mounted on a shaft 36, having a longitudinal axis 37, and the gravure roll is rotated during the electrodeposition process. Thus, even though only a portion of object 16 is in fluid communication with ionic fluid bath 14 at any given time, object 16 will still be plated over its entire external surface 38, since all parts of surface 38 are rotated through ionic fluid bath 14. The electrodeposition process can be performed on a rotating object as well as a stationary object.

Deposition material supply 12 is maintained in reservoir 20. Reservoir 20 includes a base tray 40, which is preferably supported on a support 42. In a preferred embodiment, support 42 is a piston-type support which extends between a bottom wall 44 of container 18 and base tray 40. Preferably, base tray 40 is made of a titanium sheet. A liner 46 is preferably disposed between base tray 40 and deposition material supply 12. A conductive sheet 48 is preferably disposed in contact with deposition material supply 12 between base tray 40 and deposition material supply 12. In a preferred embodiment, conductive sheet 48 is made of lead and disposed between liner 46 and deposition material 12. Liner 46 is preferably a plastic sheet.

To assist in drainage, both liner 46 and conductive sheet 48 may be perforated, thus allowing fluid to pass through to base tray 40. A drainage conduit 50 extends through base tray 40 to provide a drainage path for fluid filtering through conductive sheet 48 and liner 46. In a preferred embodiment, drainage conduit 50 returns the drainage fluid to fluid supply 28.

Figure 2:
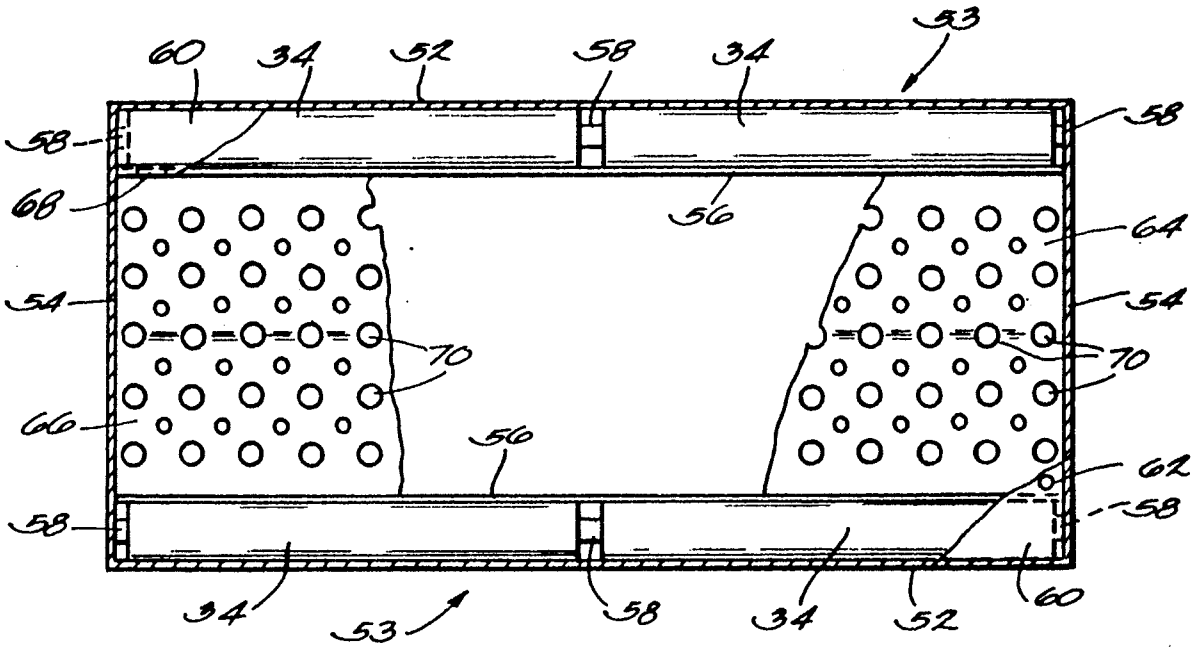
FIG. 2 is a top plan view showing details of the invention with the object to be plated removed.

Referring now to FIG. 2, in a preferred embodiment, reservoir 20 has a generally U-shaped configuration. A pair of exterior retaining walls 52 extend upward from base tray 40 and define a pair of outer longitudinal sides 53 of reservoir 20. A pair of end walls 54 are disposed at the longitudinal ends of reservoir 20. Reservoir 20 can have shapes other than that shown in the preferred embodiment. However, when plating gravure rolls, reservoir 20 preferably extends for a greater length in a direction generally parallel with longitudinal axis 37 of gravure roll 16.

A pair of interior retaining walls 56 preferably extend upward at a spaced distance from retaining walls 52. Preferably, all of deposition material supply 12 is contained between interior retaining walls 56. Disposed between each interior retaining wall 56 and exterior retaining wall 52 are filter tubes 34. Filter tubes 34 extend longitudinally between retaining walls 52 and 56, generally parallel with axis 37, and preferably for the entire length of reservoir 20. Filter tubes 34 may comprise a plurality of shorter filter tubes which are mounted on a plurality of brackets 58 extending from reservoir 20 as shown in FIG. 2. Additionally, disposed over each filter tube 34 is a capping member 60. Each capping member 60 includes a plurality of orifices 62. Thus, when the electrodeposition process is taking place, each filter tube 34 is enclosed between a retaining wall 52, an inner retaining wall 56, a portion of liner 46, and capping member 60.

Barrier 24 is disposed between deposition material supply 12 and object 16. Barrier 24 extends between each interior wall 56, thus covering deposition material supply 12, which would otherwise be exposed to object 16. In this manner, any ions given up by deposition material supply 12 must pass through barrier 24 before they can contact object 16. However, barrier 24 will prevent any oxides and other undesirable contaminants from flowing into close proximity to object 16 where they could potentially come in contact with object 16 causing surface deformations in the deposition material which is deposited on object 16. Barrier 24 is preferably made from a sheet of polypropylene including vias appropriately dimensioned to facilitate passage of ionic fluid between deposition material supply 12 and object 16 while impeding passage of copper oxides and other contaminants and particles which may be in the ionic fluid or may be produced by the electrodeposition process.

Diffusion member 26 is similarly disposed between deposition material supply 12 and object 16. In a preferred embodiment, diffusion member 26 includes a first titanium grid 64 and a second titanium grid 66. Both titanium grids are preferably mounted on a hinge 68 and can thus be pivoted away from deposition material supply 12 to facilitate removal of object 16 from ionic fluid bath 14. Preferably, barrier 24 is disposed between first and second titanium grids 64, 66. Thus, barrier 24 is held securely in place and ions can be diffused and filtered prior to passing from deposition material supply 12 into proximity with object 16. First and second titanium grids 64, 66 include a multiplicity of apertures 70 Which allow ions to pass through while promoting diffusion of the ions. In a preferred embodiment, apertures 70 are circular, are less than 2 inches in diameter, and are various in size. By diffusing the ions, the ions become more uniformly distributed through ionic fluid bath 14 and thus are attracted to object 16 in a more uniform fashion, yielding greater uniformity in plating deposition.

Uniform dispersion of ions in fluid bath 14 is also facilitated when ionic fluid passes through filter tubes 34. That is, filter tubes 34 not only filter out oxides and other contaminants, but also promote uniform ionic fluid distribution along the length of reservoir 20. Filter tubes 34 are preferably constructed with a polypropylene material which, in a most preferred embodiment, is a $4\times10$ microns polypropylene material which restricts the flow of ionic fluid into fluid bath 14. Fluid enters a hollow interior portion 71 of filter tubes 34 and then flows radially outward through the polypropylene material and into fluid bath 14. The restrictive polypropylene filter material ensures that filter tubes 34 will at least partially fill with ionic fluid and promote slow, even distribution of ionic fluid along the length of reservoir 20, thus promoting ionic dispersion and uniform adherence of ions to object 16.

Ionic fluid is supplied to filter tubes 34 via conduit 30 which is preferably a PVC pipe. Conduit 30 is connected to fluid pump 32 and extends through fluid supply tank 28. Conduit 30 extends through bottom wall 44, through base tray 40, and into filter tubes 34 to supply ionic fluid to interior portions 71 of filter tubes 34. Since the filter tubes 34 restrict the flow of fluid, filter tubes 34 are generally filled with ionic fluid being supplied through conduit 30, thus promoting even distribution of ionic fluid along the length of reservoir 20, as discussed above.

The fluid level in container 18 is maintained by an overflow wall 72 which is disposed at a spaced distance from an outer wall 74 of container 18. Ionic fluid bath 14 is maintained at a constant level since any excess ionic fluid flows over overflow wall 72 and into a passage 76 by which the overflowing fluid is returned to fluid supply tank 28.

The operation of electrodeposition apparatus 10 will be explained using the example of plating a gravure cylinder with a uniform layer of copper. However, the invention is not limited to the plating of gravure cylinders, nor is it limited to the use of copper as the deposition material.

In operation, reservoir 20 including deposition material supply 12 of copper, preferably in the form of copper nuggets, is submerged in ionic fluid bath 14. Ionic fluid bath 14 consists primarily of water mixed with copper ions and sulfate ions. Object 16, which in this example is a gravure cylinder, is rotated in ionic fluid bath 14 by conventional means (not shown) that are known in the art, while power source 22 supplies a charge to the gravure cylinder and to deposition material supply 12. In this exemplary preferred embodiment, a negative charge is applied to object 16 by a connector 78 connected to shaft 36 and a positive charge is applied to a bus bar 80 which bus bar 80 extends longitudinally along reservoir 20 (generally parallel with axis 37) in contact with deposition material supply 12. Preferably, the electrical potential between object 16 and deposition material supply 12 is within a range from 10 to 11½ volts, although a broader range of voltages would also be sufficient to obtain deposition of material onto object 16. As the gravure roll (i.e., object 16) rotates, ions from ionic fluid bath 14 are attracted to external surface 38 of object 16 and deposited in a fine, generally uniform layer. As the ions are deposited on external surface 38, additional ions are pulled free from deposition material source 12 to replenish ionic fluid bath 14. Additionally, fluid, typically ionic fluid, is pumped from fluid supply tank 28 into filter tubes 34 to maintain the level of ionic fluid bath 14. Filter tubes 34 ensure that contaminants do not enter ionic fluid bath 14 and also disperse the fluid evenly into fluid bath 14.

By operating the described apparatus 10, gravure cylinders can be reconditioned much more efficiently and with less waste of deposition material. This is largely due to the uniformity with which a new deposition layer may be applied to the gravure cylinder.

Figure 3:
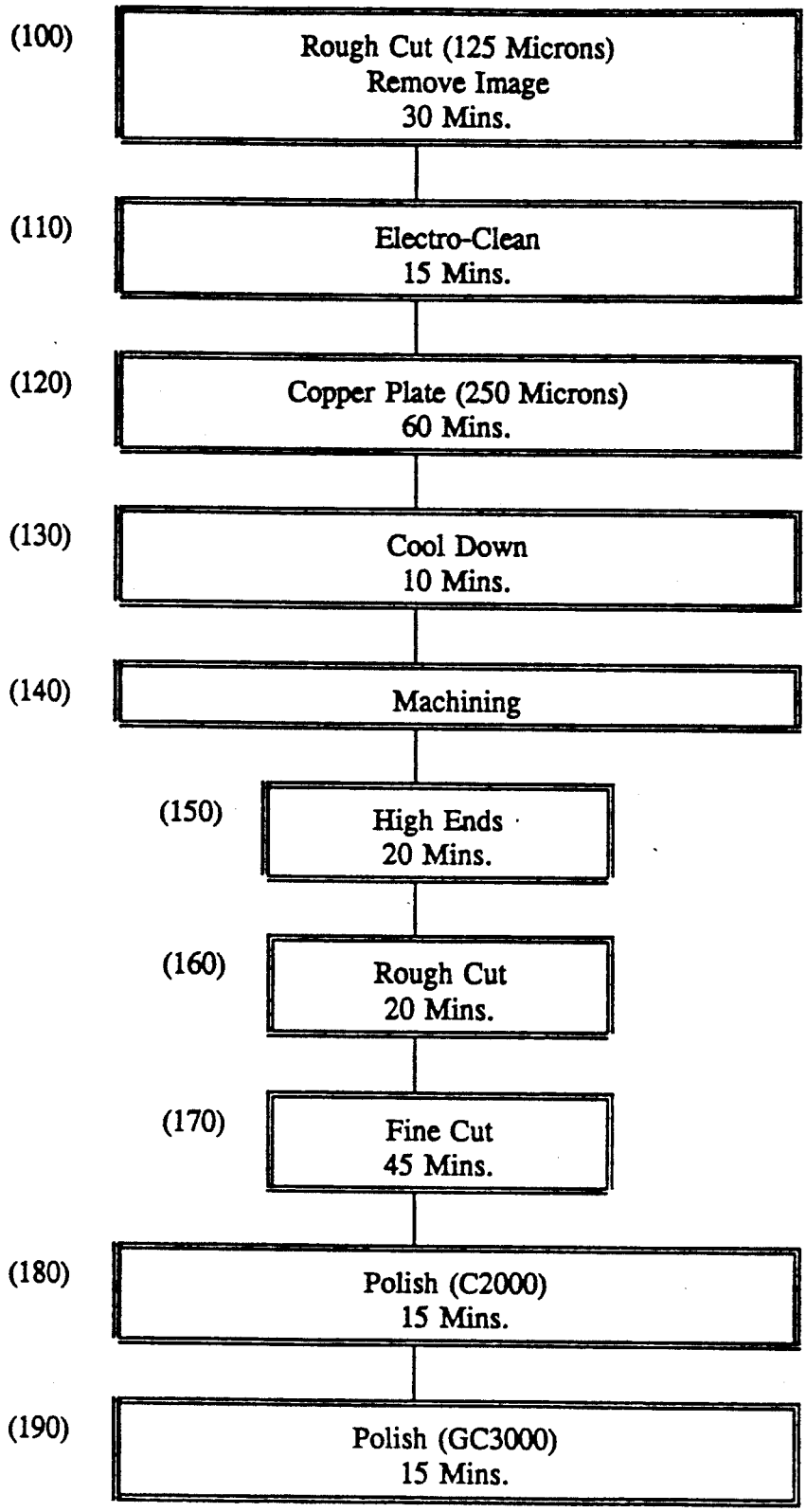
FIG. 3 is a flow chart showing the prior art method for reconditioning a gravure roll.

As shown in FIG. 3, a typical method for reconditioning a gravure cylinder, according to the prior art, involved time consuming extra steps. The cylinder was first rough cut to remove a layer of copper, approximately 125 microns thick (100). This removed the etched image and some additional material from the gravure cylinder. The cylinder was then transferred to a cleaning tank where contaminants, such as soils and oxides, were removed (110). The cleaning tank was typically an electro cleaning tank. Following cleaning, the gravure cylinder was plated with a new layer of deposition material, copper, which was approximately 250 microns thick (120). This 250 micron layer was thick enough to replace the layer which had previously been removed and to supply an additional layer, approximately 125 microns thick, for necessary machining. The machining was necessary to provide the gravure cylinder with a sufficiently smooth and uniform surface for printing. After receiving the new copper layer, the cylinder was cooled, preferably to approximately 72° C. (130).

Once cooled, the plated gravure cylinder was ready for machining (140). First, the high cylinder edges were end milled (150). Then a layer approximately 75 microns thick was removed by rough cutting (160). This was followed by the fine cutting of an additional layer of material, approximately 50 microns thick (170). Overall, a layer, approximately 125 microns thick, was removed from the gravure cylinder. In the final step, the cylinder was polished with polishing wheels. The surface was typically first polished with a polishing wheel having a grit rating of C2000 (180) and this was followed with further polishing by a polishing wheel having a grit rating of GC3000 (190).

The approximate time required for each step is shown in FIG. 3 as well as the approximate overall time of three hours and 50 minutes. This prior art method was complex, time consuming, and led to excess waste of deposition material.

Using electrodeposition apparatus 10, described above, a much more efficient method for reconditioning gravure cylinders is made possible. According to this new method for reconditioning the surface of gravure cylinders, an old layer of deposition material is removed from the gravure cylinder. Once this deposition material is removed, a subsurface is exposed. This subsurface is then cleaned of any remaining contaminants, such as soils or oxides. A new layer of the deposition material is then uniformly applied over the subsurface until the new layer is of approximately the same thickness as the old layer, earlier removed. This new layer is applied uniformly with electrodeposition apparatus 10, thus leaving a smooth surface which requires minimal machining. The final step of the process involves polishing the new layer of deposition material.

Figure 4:
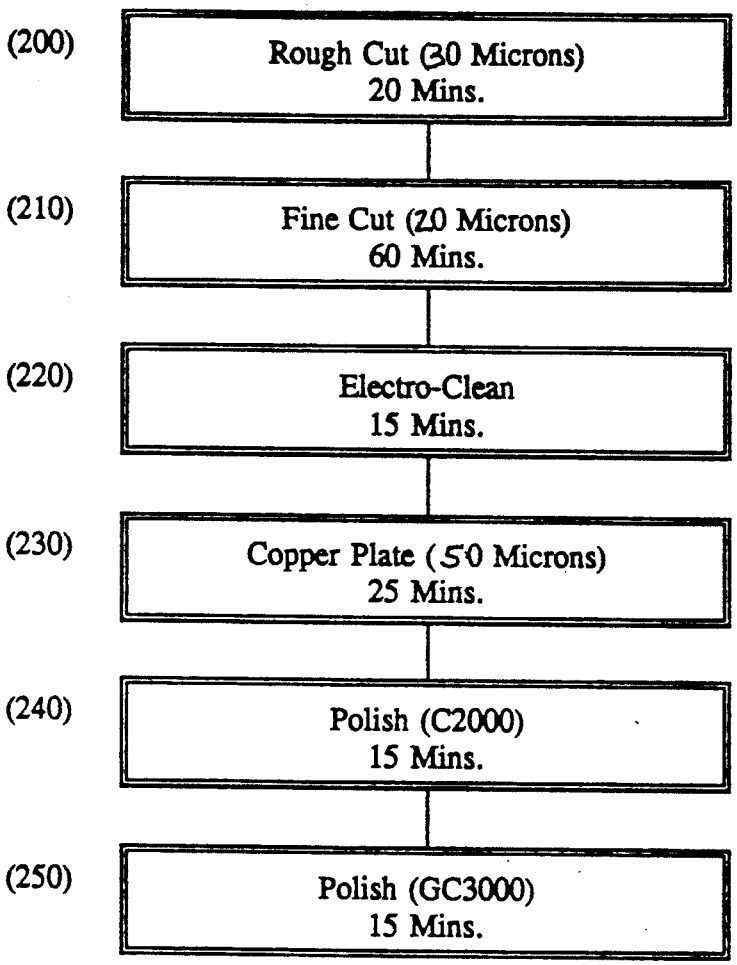
FIG. 4 is a flow chart showing the method for reconditioning a gravure roll according to the present invention.

According to the most preferred method shown in FIG. 4, a layer, approximately 60 microns thick, is rough cut from the gravure cylinder being reconditioned (200). This is followed by fine cutting a layer, approximately 40 microns thick, from the gravure cylinder (210). After removing both layers, together approximately 100 microns thick, a subsurface is exposed and cleaned of oxides and contaminants (220). Following the cleaning step, a uniform layer of deposition material, approximately 100 microns in thickness, is electrodeposited on the subsurface (230). This new layer of deposition material is then polished to a first level of smoothness and then further polished to a second level of smoothness, preferably first with a C2000 polishing wheel (240), followed by a GC3000 polishing wheel (250). Thus, electrodeposition apparatus 10 allows an easier method of reconditioning gravure cylinders where there is less machining, less waste of electrodeposition material, and substantial time savings. FIG. 4 shows the approximate time required for each step as well as the approximate overall time of two hours and 30 minutes.

It will be understood that the foregoing description is of a preferred exemplary embodiment of this invention, and that the invention is not limited to the specific forms shown. For example, the described apparatus for electrodeposition may be used with different objects, may be of different size or shape, and may use a variety of different materials. Similarly, the steps of the new method of reconditioning gravure cylinders may be varied, for example, by removing or adding layers of deposition material having different thicknesses than those disclosed. These and other modifications may be made in the design and arrangement of elements without departing from the scope of the invention as expressed in the appended claims.

What is claimed is:

1. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object; and a barrier means for impeding the passage of contaminants from said deposition material supply to said object and diffusing said ions through said fluid bath during the deposition of said ions upon said object, said barrier means being disposed intermediate said object and said deposition material supply.

2. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object;

a barrier means for impeding the passage of contaminants from said deposition material supply to said object, said barrier means being disposed intermediate said object and said deposition material supply; and a diffusion member for diffusing said ions through said ionic fluid bath during the deposition of said ions upon said object, wherein said diffusion member is disposed intermediate said object and said deposition material supply.

3. The apparatus of claim 2, wherein said diffusion member is disposed intermediate said barrier means and said object.

4. The apparatus of claim 2, wherein said diffusion member is disposed intermediate said barrier means and said deposition material supply.

5. The apparatus of claim 4, further comprising a conduit extending through said reservoir means, said conduit being configured to deliver said fluid to said filter when said fluid is added to said fluid bath.

6. The apparatus of claim 5, wherein said filter material comprises a 4×10 microns polypropylene filter.

7. The apparatus of claim 6, wherein said diffusion member further includes a second grid having a multiplicity of apertures extending therethrough, said second grid being disposed in generally parallel alignment with said first grid.

8. The apparatus of claim 7, wherein said vias are of sufficient size to permit the passage of copper ions and sulfate ions.

9. The apparatus of claim 5, wherein said filter is a tube having a hollow interior portion, wherein said fluid enters said hollow interior portion and passes radially through said tube into said fluid bath.

10. The apparatus of claim 9, wherein said grids are made from titanium.

11. The apparatus of claim 9, wherein said barrier means comprises a sheet having vias, said sheet being disposed between said first grid and said second grid.

12. The apparatus of claim 4, wherein said filter is configured to filter an ionic fluid.

13. The apparatus of claim 4, wherein said diffusion member comprises a grid having a multiplicity of apertures extending therethrough.

14. The apparatus of claim 13, wherein said barrier means comprises a polypropylene material.

15. The apparatus of claim 4, wherein said barrier means comprises a sheet having vias.

16. The apparatus of claim 2, wherein said diffusion member comprises a first grid and a second grid, said barrier means being disposed intermediate said first grid and said second grid.

17. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object;

a barrier means for impeding the passage of contaminants from said deposition material supply to said object, said barrier means being disposed intermediate said object and said deposition material supply; and a filter, disposed in said fluid bath generally parallel to a longitudinal axis of said object, for filtering a fluid when said fluid is added to said ionic fluid bath, wherein said filter is configured to provide uniform distribution of said fluid into said fluid bath.

18. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object;

a barrier means for impeding the passage of contaminants from said deposition material supply to said object, said barrier means being disposed intermediate said object and said deposition material supply;

a diffusion member for diffusing said ions through said ionic fluid bath during the deposition of said ions upon said object, wherein said diffusion member is disposed intermediate said object and said deposition material supply; and a filter, disposed in said fluid bath generally parallel to a longitudinal axis of said object, for filtering a fluid when said fluid is added to said ionic fluid bath, wherein said filter is configured to provide uniform distribution of said fluid into said fluid bath.

19. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object; and a diffusion member for diffusing said ions through said ionic fluid bath during the deposition of said ions upon said object, wherein said diffusion member is disposed intermediate said object and said deposition material supply.

20. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object;

a diffusion member for diffusing said ions through said ionic fluid bath during the deposition of said ions upon said object, wherein said diffusion member is disposed intermediate said object and said deposition material supply; and a filter, disposed in said fluid bath generally parallel to a longitudinal axis of said object, for filtering a fluid when said fluid is added to said ionic fluid bath, wherein said filter is configured to provide uniform distribution of said fluid into said fluid bath.

21. The apparatus of claim 20, wherein said filter is configured to diffuse the ions in said ionic fluid as said ionic fluid passes through said filter.

22. The apparatus of claim 21, wherein said filter is a plurality of tubes, each tube having a hollow interior portion.

23. An apparatus for altering the surface of an object by affecting the amount of a deposition material disposed on said object, said object being in fluid communication with an ionic fluid bath including ions of said deposition material, said apparatus comprising:

a container for holding said ionic fluid bath;

a reservoir means for holding a deposition material supply in fluid communication with said ionic fluid bath;

an electrical power source means for establishing an electrical field, said electrical power source means being operatively connected with said deposition material supply in said reservoir means and with said object, said electrical power source means establishing a first charge at said object, and a second charge at said deposition material supply in said reservoir means, said first charge and said second charge having opposite polarities and having substantially equal magnitudes; said first and second charges cooperating to establish said electrical field intermediate said object and said deposition material supply via said ionic fluid bath; said ionic fluid bath and said deposition material cooperating in response to said electrical field to effect deposition of said ions upon said object; and a filter, disposed in said fluid bath generally parallel to a longitudinal axis of said object, for filtering a fluid when said fluid is added to said ionic fluid bath, wherein said filter is configured to provide uniform distribution of said fluid into said fluid bath.

24. The apparatus of claim 23, wherein said filter is made from a material comprising polypropylene.

* * * * *

UNITED STATES PATENT AND TRADEMARK OFFICE

CERTIFICATE OF CORRECTION

PATENT NO. : 5,318,683

DATED : June 7, 1994

INVENTOR(S) : Smith et al.

It is certified that error appears in the above-identified patent and that said Letters Patent is hereby corrected as shown below:

Col. 1, line 50 between "cylinder" and "example" delete"."

Col. 2, line 10 delete "15".

Col. 3, line 54, after "member" insert -26-.

Col. 8, line 5, change "60" to -30-.

Col. 8, line 8, change "40" to -20-.

Col. 8, line 10, change "100" to -50-.

Col. 8, line 13, change "100" to -50-.

Signed and Sealed this

Fourth Day of October, 1994

*Attest:*

*Attesting Officer*

Bruce Lehman

BRUCE LEHMAN

*Commissioner of Patents and Trademarks*